US006106178A

United States Patent [19]

Chiu

[11] Patent Number: 6,106,178

[45] Date of Patent: Aug. 22, 2000

[54] PRINTER AND PRINTER PAPER TRAY

[75] Inventor: Andrew Shun Pui Chiu, Kowloon, The Hong Kong Special Administrative Region of the People's Republic of China

[73] Assignee: Hewlett-Packard Company, Palo Alto, Calif.

[21] Appl. No.: 09/289,653

[22] Filed: Apr. 12, 1999

[51] Int. Cl.[7] ..... B41J 11/58

[52] U.S. Cl. ..... 400/624; 400/625

[58] Field of Search ..... 400/624, 625, 400/623; 271/3.14, 4.01, 164, 171

[56] References Cited

U.S. PATENT DOCUMENTS

| | | | |
|---|---|---|---|
| 5,378,071 | 1/1995 | Uehara | 400/624 X |
| 5,620,269 | 4/1997 | Gustafson | 400/624 |
| 5,743,518 | 4/1998 | Takashimizu et al. | 271/4.1 |
| 5,746,528 | 5/1998 | Mayer et al. | 400/625 |
| 5,829,898 | 11/1998 | Hill et al. | 400/624 |

*Primary Examiner*—John S. Hilten
*Assistant Examiner*—Minh H. Chau

[57] ABSTRACT

The present invention provides a paper tray for an imaging device that includes both device for holding paper prior to printing thereon, and device for receiving paper exiting from the printer. In this way a single paper tray can both supply to and receive paper from the printer, and therefore it is only necessary to provide access to one side of the printer in which the tray is inserted. The printer may therefore be incorporated as part of a stack of other electrical/electronic items such as audio-visual equipment.

12 Claims, 15 Drawing Sheets

PRINTER AND PRINTER PAPER TRAY

FIELD OF THE INVENTION

This invention relates to a printer and to a paper tray for a printer. In particular the invention relates to a printer for a personal computer and the like that may be stacked as one component for many electronic/electrical components or rack mounted as part of an instrument rack system.

BACKGROUND OF THE INVENTION

In recent years computers have increasingly found a place in the domestic environment as well as in office and business situations. A large number of homes now have some form of personal computer for domestic use, and this normally implies in addition the presence of at least some peripheral devices such as a simple computer printer.

Conventionally a domestic personal computer is provided quite separately from other electrical/electronic home devices such as television sets, video recorders, laser disc players and hi-fi or audio-visual equipment. Often currently the computer may be in a different room, a study for example while the television will be in the living room. Increasingly, however, there is a growing tendency towards integration of all such devices. Audio-visual and "home cinema" systems are beginning to integrate what previously were separate television and audio equipment. With the advent of cable television systems offering Internet access, computing is also now being included in one integral package with audio-visual systems.

This introduces a difficulty, however, with conventional computer peripherals such as printers in particular. These are normally designed as stand-alone items and generally are not designed with aesthetic considerations primarily in mind. It would for most people be highly undesirable to have a computer printer in the living room next to the television and hi-fi equipment.

It would therefore be desirable to provide a computer printer that can be easily incorporated within a domestic audio-visual system. Such systems are usually arranged as stacks of components (eg television set, CD player, video player, amplifier and so on) and if the television set is to double as a form of computing device, it would be highly desirable to be able to incorporate the printer in such a stack.

The problem with doing this, however, is that space has to be provided both to access the printer to allow paper to be inserted, and to allow paper to exit the printer following a printing operation. In a conventional free-standing printer this is not a problem, and most printers have means to insert a paper tray in one side of the printer and for the paper to exit the printer from another side (usually either a top surface or the opposite side of the printer from the paper tray). Such conventional designs do not allow a printer to be "stacked" as part of other equipment.

Also known in the prior art are printers adapted to print images from video sources. Such known printers include a paper tray that is receivable in the front of the printer, and a separate paper output tray located in a slot closely adjacent and above the paper tray. However, such printers are only suitable for printing small paper sixes, eg postcard sizes, and cannot be used to print on A4 or letter size paper as is more normally required.

SUMMARY OF THE INVENTION

According to the present invention there is provided a paper tray adapted to be inserted in a side of a printer or like device, said paper tray having means for holding paper prior to printing thereon and means for receiving paper exiting the printer after printing thereon, wherein the paper receiving means is movable between a first inoperative position and a second operative position in which the paper receiving means is extended to receive paper thereon.

By means of this arrangement it is only necessary for one side of the printer to be easily accessed since single paper tray serves both to supply paper to the printer and to receive printed paper. The paper holding means and the paper receiving means are integrated into a single paper tray that can be inserted in the front side of the printer. The printer can therefore be stacked with other components.

The fact that the paper receiving means is movable allows the most efficient use of space since the paper receiving means can be extended only when required. Preferably when the paper receiving means is in the first position it may be received substantially within the maximum dimensions of the paper tray that are received within the printer when in use whereby when the tray is inserted in a printer and the paper receiving means is in the first position substantially all of the tray is received within the printer.

Preferably the paper receiving means includes at least one paper supporting member adapted to extend telescopically from the paper tray. The tray may comprise a first paper supporting member that telescopes with respect to the paper tray, and a second paper supporting member that telescopes with respect to the first member. The paper tray may further comprise a paper supporting flap that folds out from an inoperative position to an operative position.

In the preferred embodiment the paper holding means comprises a paper cassette received within said paper tray. The paper tray is preferably generally rectangular and is formed with side and end walls, and preferably the paper cassette is generally rectangular and formed with side and end walls, the paper cassette being closely received within at least the side walls and one end wall of the paper tray.

The paper cassette may be adapted to be moved upon insertion into a printer or the like from a lower position in which the paper cassette is completely received within the paper tray such that the walls of the paper tray and the walls of the paper cassette are generally at the same height, to a raised position in which the walls of the paper cassette are raised above the walls of the paper tray. This may be achieved, for example, by forming the side walls of the paper cassette with cam pins that extend through corresponding vertical slots formed in the side walls of the paper tray.

It will also be understood that the present invention extends to a printer or like device incorporating a paper tray as described above.

Viewed from another broad aspect the present invention provides a printer having an opening in a wall thereof for receiving a paper tray, the printer further including a paper discharge opening located immediately above the tray receiving opening, whereby paper discharged through the discharge opening may be received by the paper tray.

Viewed from still another broad aspect the invention further provides a printer having an opening in a wall thereof for receiving a paper tray, the paper tray having an extendible paper receiving portion, wherein when the paper receiving portion is in an unextended state the paper tray is received completely within the printer.

BRIEF DESCRIPTION OF THE DRAWINGS

An embodiment of the invention will now be described by way of example and with reference to the accompanying drawings, in which.

DETAILED DESCRIPTION OF PREFERRED EMBODIMENT

Figure 1:
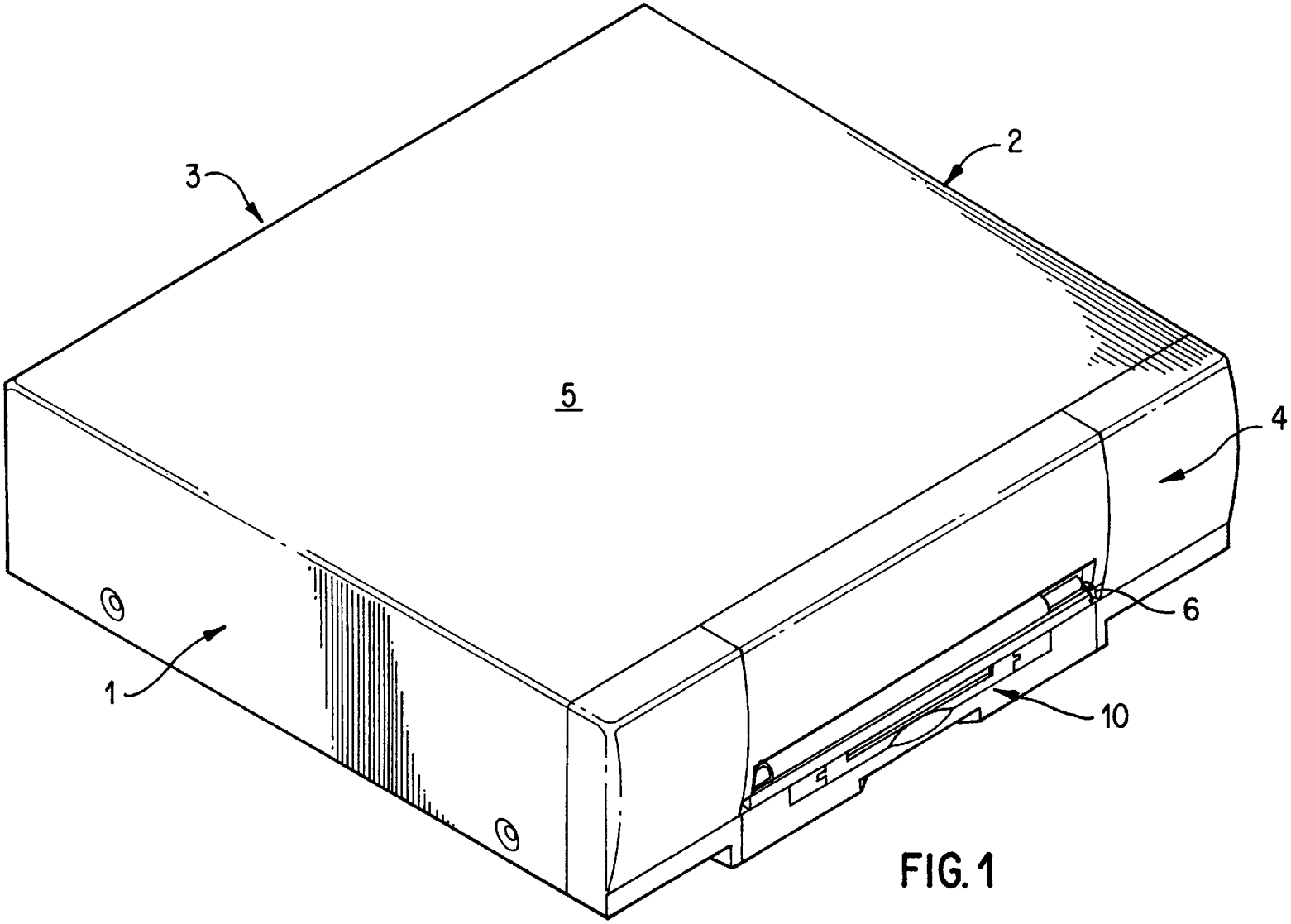
FIG. 1 is a perspective view of a printer according to an embodiment of the invention.
Figure 2:
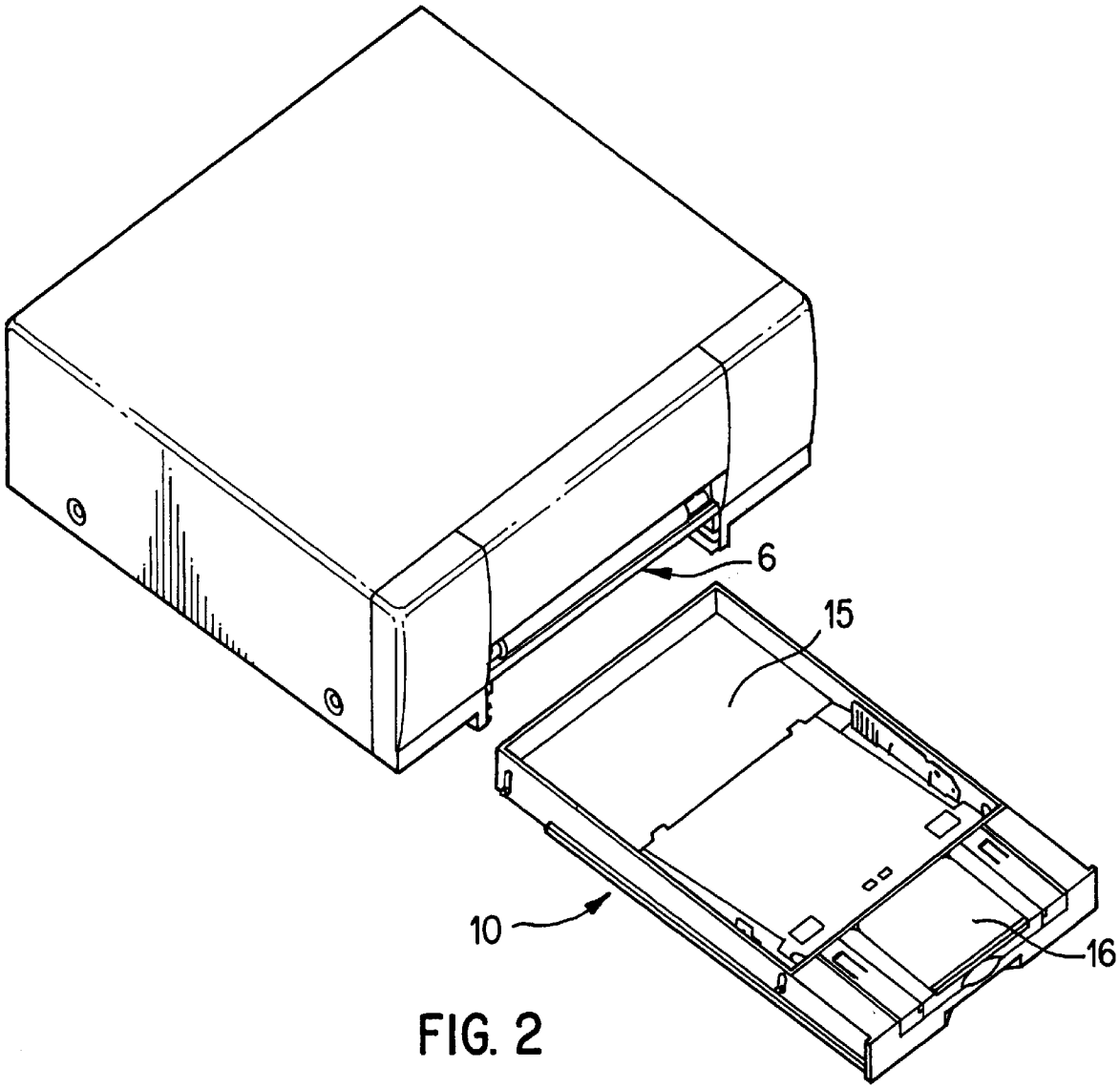
FIG. 2 is a perspective view of the printer of FIG. 1 with the paper tray fully removed.

Referring firstly to FIG. 1 there is shown a printer of a generally square construction. The printer has left and right sides 1,2, a rear side 3, a front side 4, and a top surface 5. Naturally there is a bottom surface opposite the top surface but this is not visible in the Figures. The front side 4 is provided with a slot 6 for insertion of a paper tray 10 which in FIG. 1 is received completely within the slot. FIG. 2 shows the paper tray 10 completely removed from the paper tray insertion slot of the printer. The rear side 3 of the printer is provided with means for receiving a power input, and means for receiving a data input from a computer or the like for transmitting print data.

The paper tray 10 includes both a paper holding means in the form of a paper cassette 15 for holding paper in advance of the paper being printed thereon by the printer, and also paper receiving means 16 for receiving paper exiting the printer after it has been printed thereon. These parts of the paper tray 10 will be described in more detail below, but the effect of this design is that a single paper tray inserted in a single side of the printer both holds paper for printing on, and receives paper once printing has been completed. This in turn means that only this front side 4 of the printer need be easily accessible and exposed. Thus the printer may be stacked in a collection of other electrical/electronic devices such as a television, CD player, video player, amplifier and soon.

Figure 3:
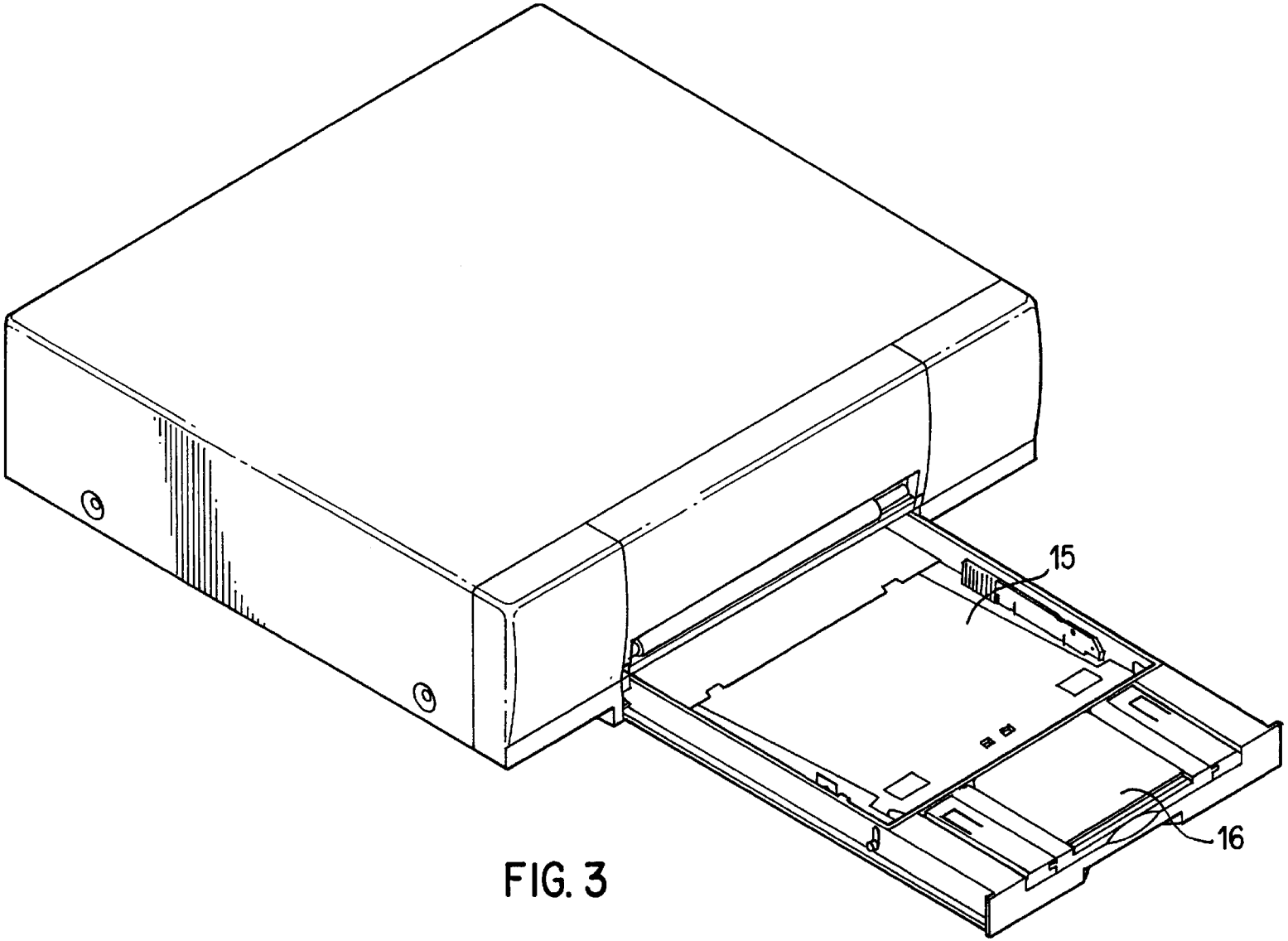
FIG. 3 is a perspective view of the printer of FIG. 1 with the paper tray partially removed.

In use the paper tray 10 is located in the insertion slot 6 and is fully received within the printer body so that there is minimal extension of the paper tray beyond the front side of the printer other than for the extending paper receiving portion as will be described further below. The paper tray may be removed entirely (FIG. 2) or partially (FIG. 3) to allow access to the paper cassette 15 in particular to allow new paper to be added. The paper tray will now be described in more detail with reference to FIGS. 4 to 6.

The paper tray 10 is of a generally rectangular construction and has side walls 11,12, an inner end wall 13 that when the tray 10 is located in the printer is received furthest in the printer body, and an outer end wall 14 that when the tray 10 is inserted in the printer lies generally flush with the printer front side 4. Paper tray walls 11 to 14 are all of substantially the same height. The paper tray comprises a paper cassette 15 and extendible paper receiving means 16. The cassette 15 is the larger of the two parts of the tray and occupies about between ⅔ and ¾ of the area of the tray with the paper receiving means in an unextended state. The paper cassette 15 is sized so as to receive a standard paper size, such as A4 paper. Within the paper cassette 15 is provided a biasing base plate 17 pivotally mounted at one end by pivots 18 to the bottom of the paper cassette 15 and arranged to bias paper held within the cassette 15 upwardly against comer separator members 19. Also provided in the paper cassette 15 is a side retaining member 20 that engages the sides of a paper stack held within the paper cassette 15 so as to align the stack.

Figure 4:
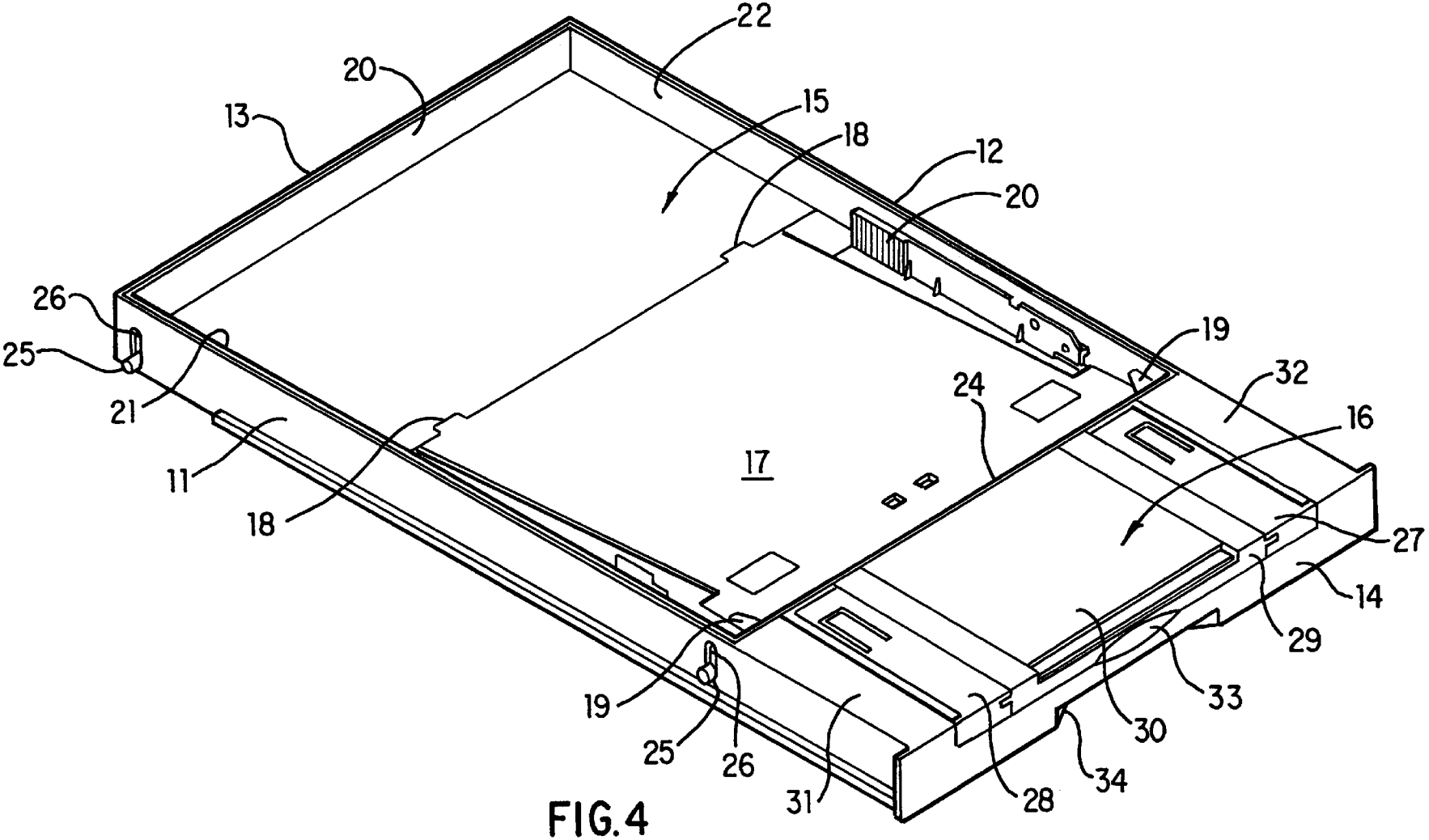
FIG. 4 is a perspective view of the paper tray with an input paper holder in a lower position.
Figure 5:
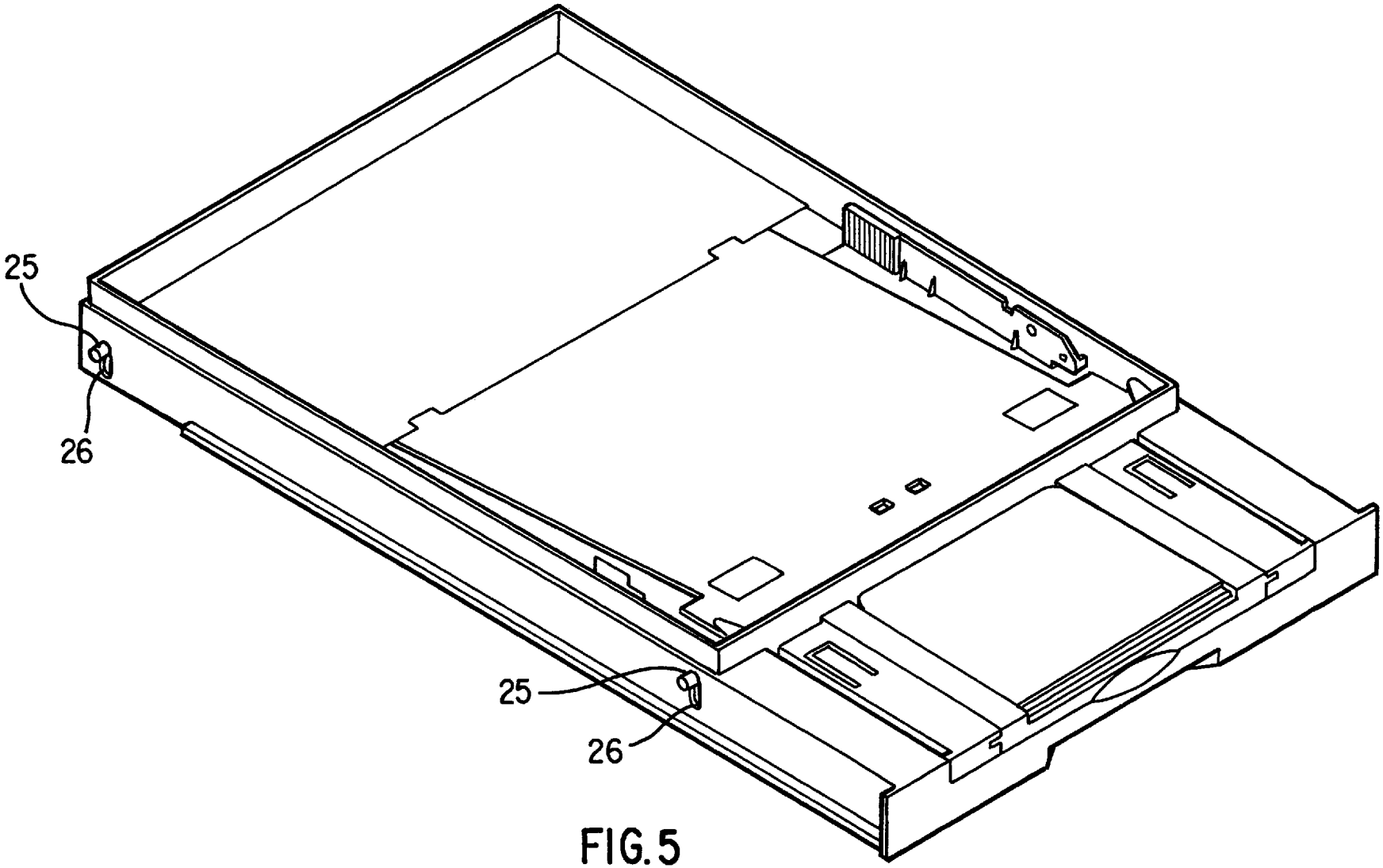
FIG. 5 is a view similar to FIG. 4 but with the input paper holder in an upper position.

The paper cassette 15 is in the form of an open top rectangular box of four sides 21–24 that is closely received within the paper tray 10 and the sides of which are of such a height that the tops of the sides of the paper tray lie normally at the same height as the walls 11–14 of the paper tray 10 and are received closely therein. The paper cassette 15 is, however, adapted to move vertically with respect to the paper tray 10 and to this end is provided with four cam pins 25 provided at each end of the long sides 21,22 of the paper cassette 15 and which pass through vertically oriented slots 26 in the corresponding side walls 11,12 of the paper tray 10. In use of the paper tray 10, when the tray 10 is fully inserted in the printer body, the cam pins 25 engage cam surfaces provided within the printer and are moved vertically to move the paper cassette 15 from a lower position as shown in FIG. 4 to an upper position as shown in FIG. 5. In the upper position of FIG. 5 the top sheet of a stack of paper held in the paper cassette 15 is in a position ready to be engaged by a paper pick-up roller within the printer to be fed to a printing means.

The paper receiving means 16 is designed to be telescopically extendible so that when not in use it occupies a minimum amount of space, but when in use it extends so that it has dimensions sufficient to support paper of the same size as is held in the paper cassette 15 (eg A4 size paper). To this end the paper receiving means 16 comprises two outer members 27,28 that are adapted to slide with respect to the sides of the paper tray 10, stop members (not shown) being provided to prevent the paper receiving means 16 from coming away from the paper tray 10. Received in turn within the outer members 27,28 is a paper support member 29 that is adapted to slide in grooves formed on the inner sides of the outer members 27,28 so that the support member 29 can slide outwardly with respect to the printer body and the outer members 27,28. Again a stop member is provided to prevent the paper support member 29 from becoming disengaged from the outer members 27,28. The paper support member 29 can be further extended in length by means of a paper support flap 30 that folds about an outer side edge of the paper support member 29 between a position in which it overlies the paper support member 29 and an extended position in which it is able to further support paper received by the paper receiving means 16.

Figure 6:
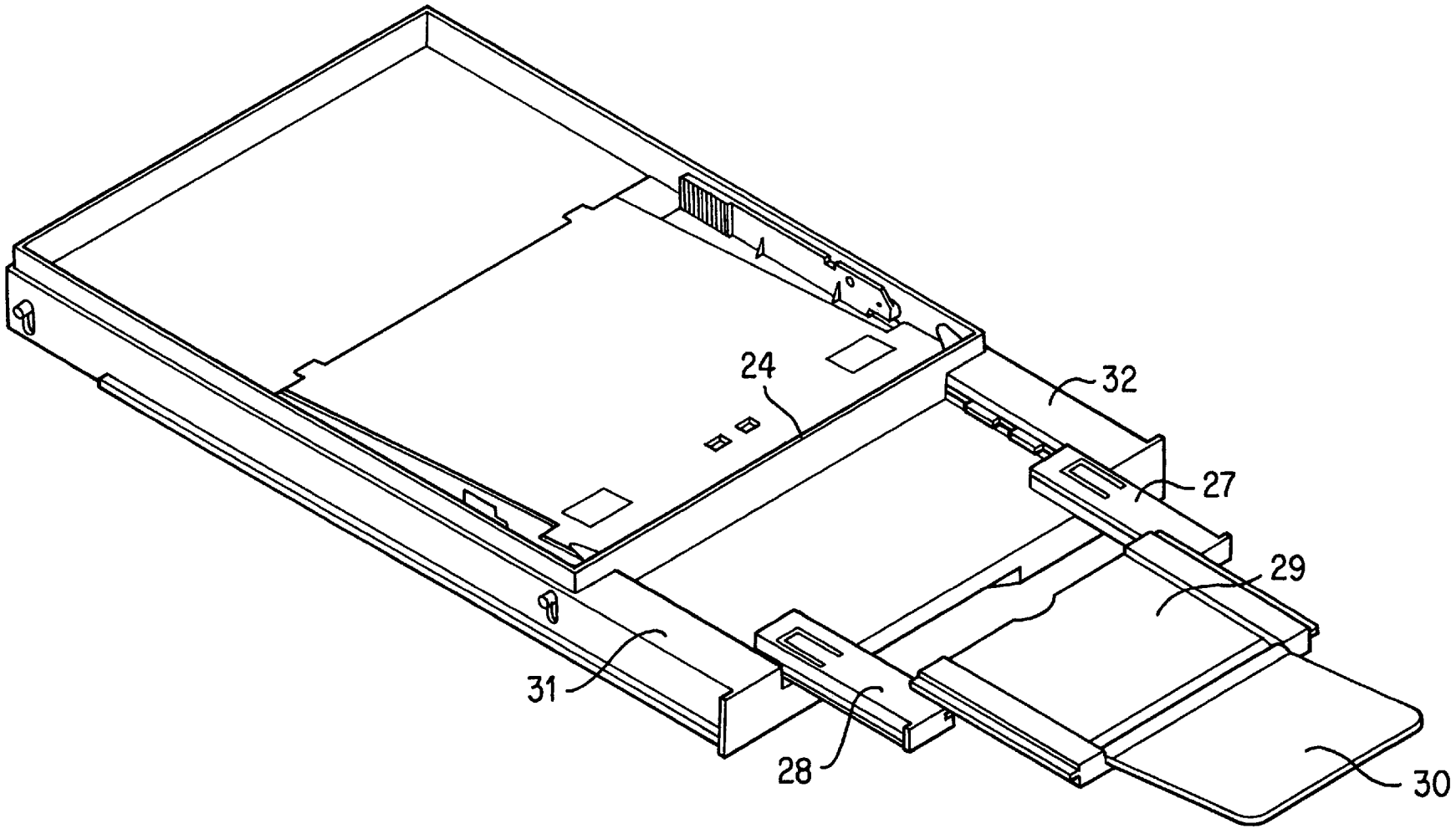
FIG. 6 is a perspective view of the paper tray with the paper receiving portion extended.
Figure 7:
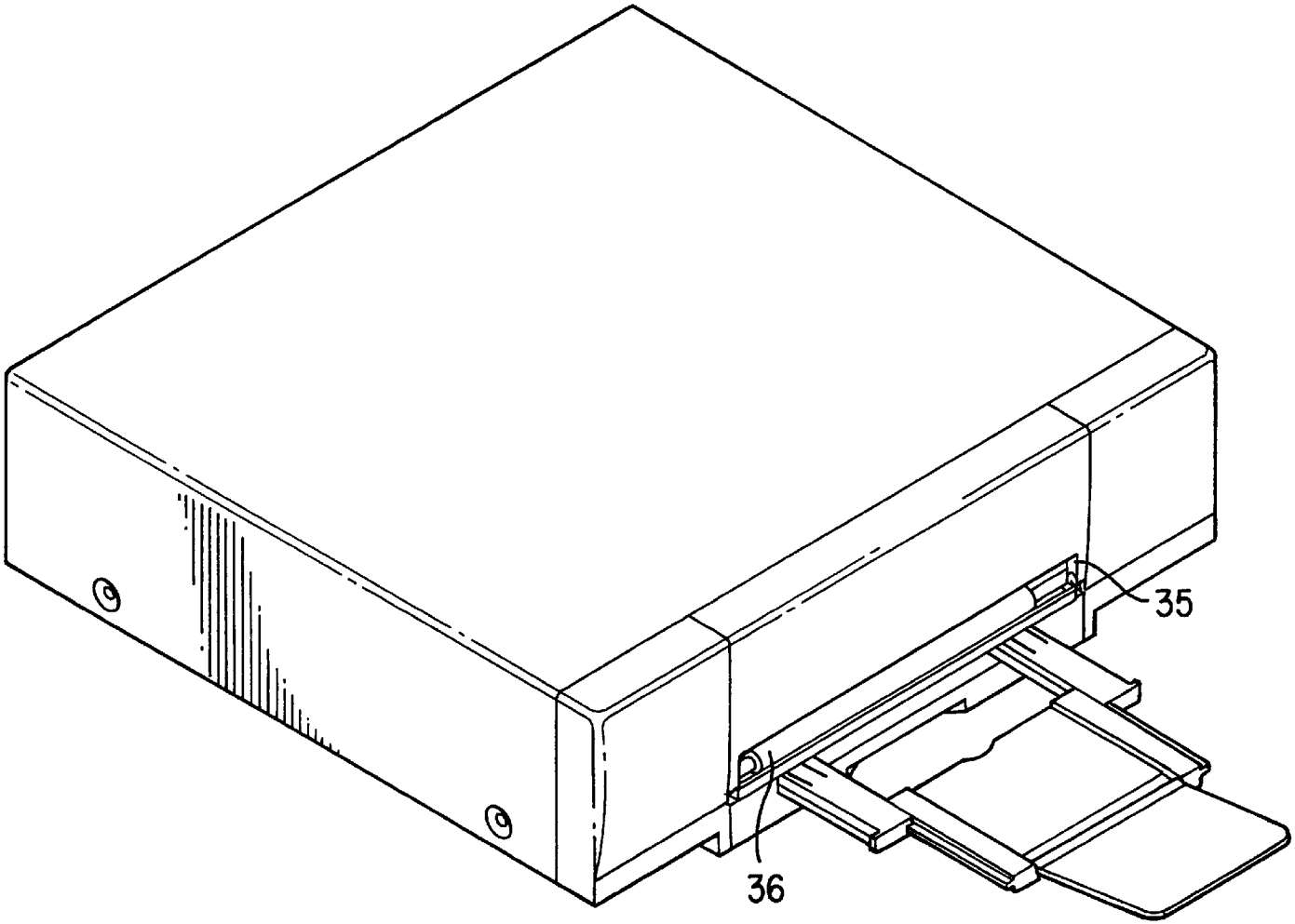
FIG. 7 is a perspective view of the printer of FIG. 1 with the paper tray inserted and the paper receiving portion extended.
Figure 8:
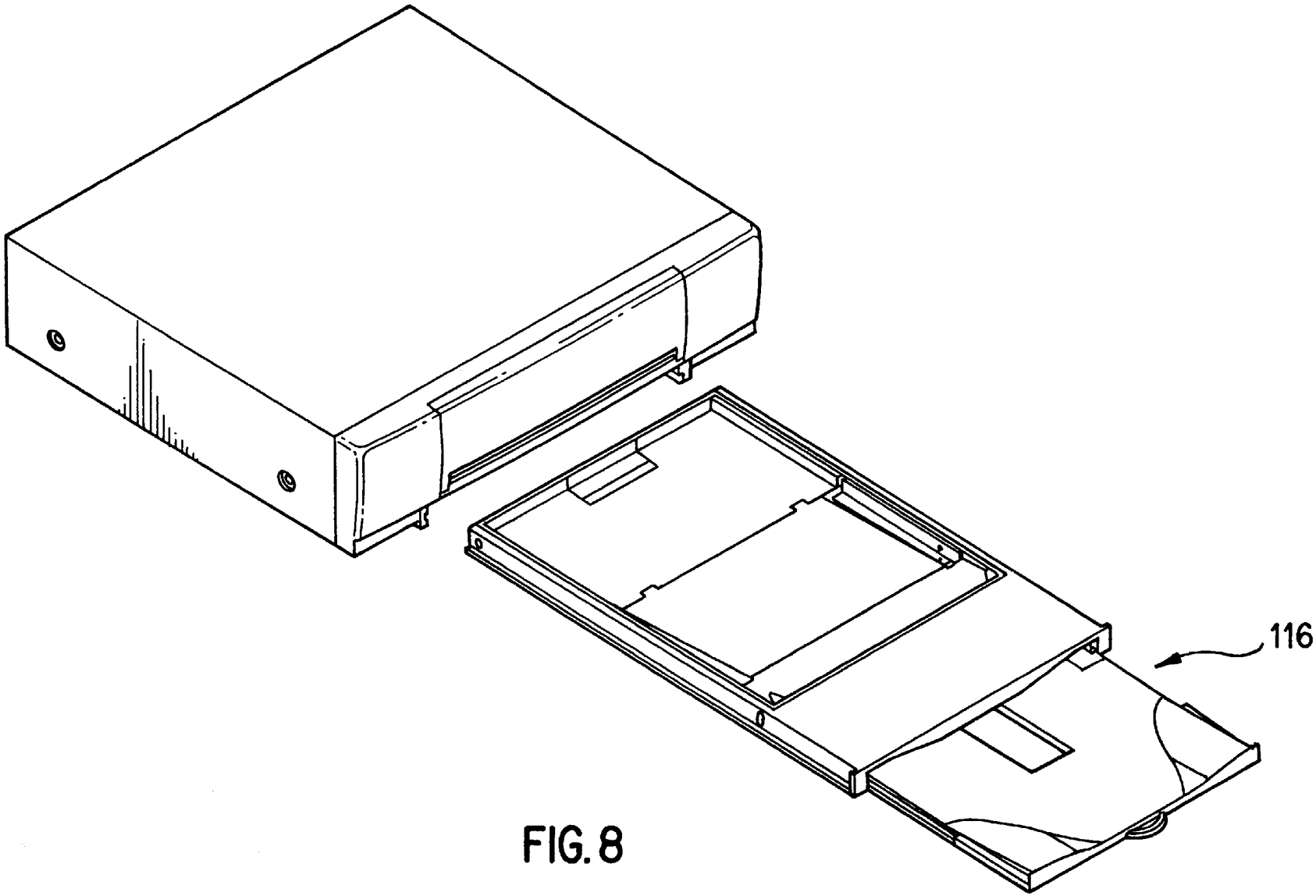
FIG. 8 is a perspective view of a second embodiment with the paper tray removed from the printer and the paper receiving portion extended.
Figure 9:
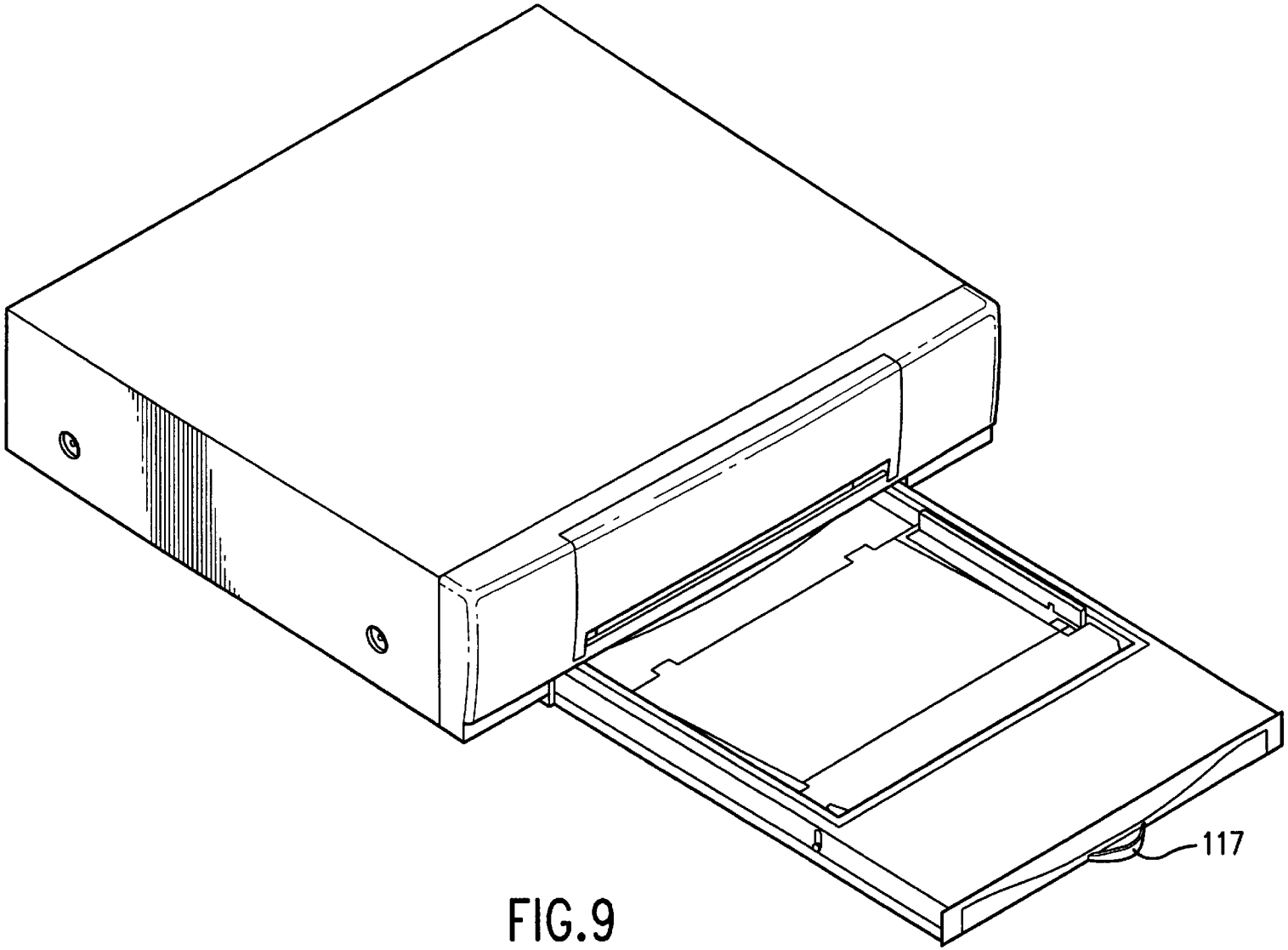
FIG. 9 is a perspective view of the second embodiment with the paper tray partly received within the printer body.
Figure 10:
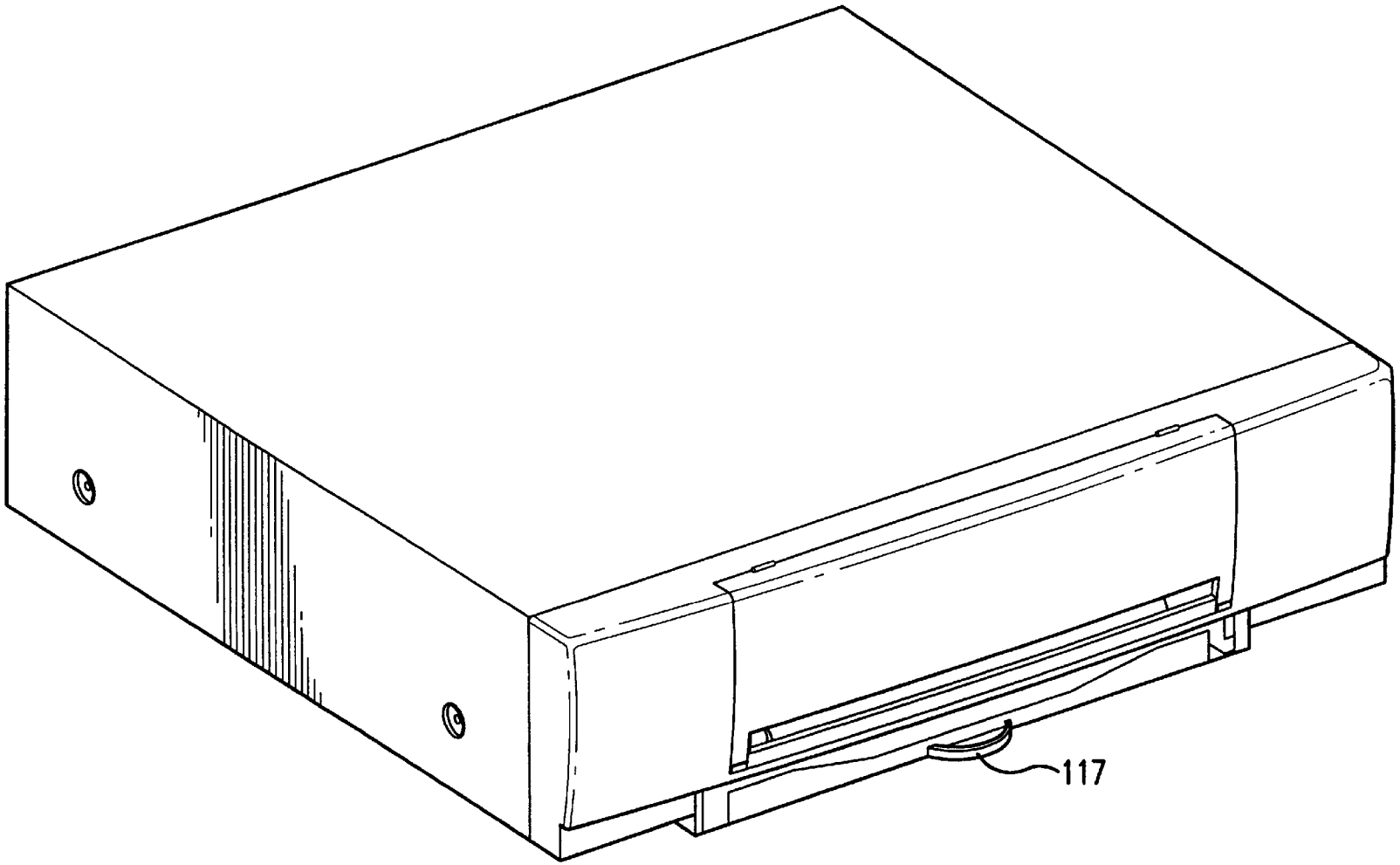
FIG. 10 is a perspective view of the second embodiment with the paper tray fully received within the printer body and without the paper receiving portion extended.
Figure 11:
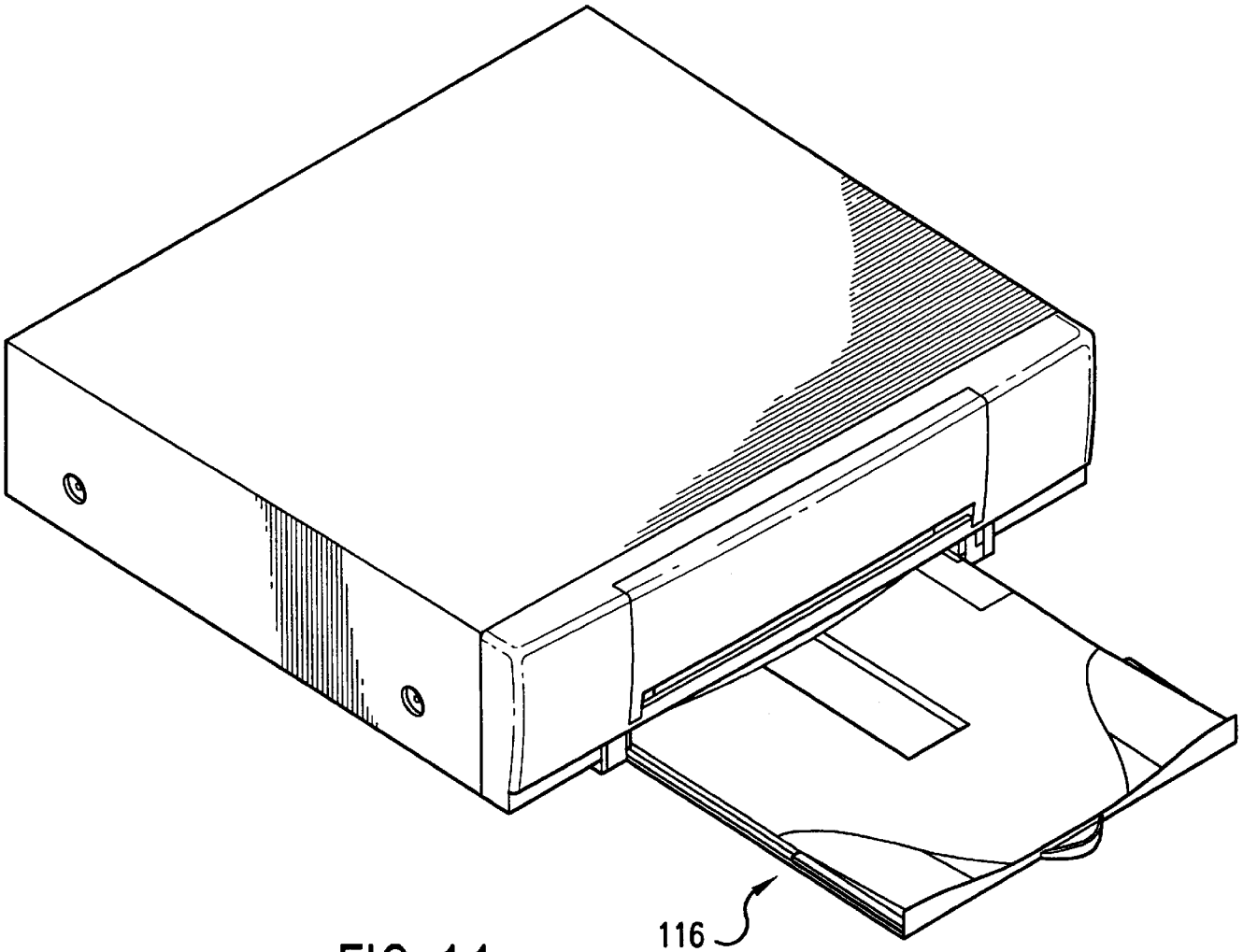
FIG. 11 is a perspective view of the second embodiment with the paper tray fully received within the printer body and with the paper receiving portion extended.

In the maximum extended state shown in FIG. 6 the paper receiving means 16 has a length in the direction that paper is discharged from the printer extending from the end 10 side wall 24 of the paper cassette 15 to the distal end of the paper support flap 30 that is substantially the same as the length of one sheet of paper. When the paper receiving means 16 is not required, however, the paper support flap 30 folds over the paper support member 29, the paper support member 29 slides within the outer members 27,28 and the outer members 27,28 in turn slide within the paper tray such that the position of FIG. 4 is taken up and the paper receiving means 12 is completely located within the dimensions of the paper tray for minimum space considerations. It will be noted in particular that the end of the paper tray 10 bearing the paper receiving means 16 is formed with a recess such that when the paper receiving means is in its non-operative unextended position upper surfaces of the outer members 27,28 and the folded-over surface of the paper support flap 30 lie flush with upper surfaces 31,32 of the paper tray 10.

It will also be seen from FIG. 4 in particular that a cut-away recess 33 is provided at the end of the paper tray 10 immediately below the paper support member 29 so that when the paper tray 10 is completely received within the printer body, it is possible for a user to pull out the paper receiving means 16 so that the paper receiving means 16 extends from the position of FIG. 1 (completely within the printer body in an unextended state) to the position of FIG. 6 (ready to receive paper exiting the printer body). It will also be noted that a second larger cut-away recess 34 is provided beneath the recess 33 and formed in the paper tray 10 so as to allow a user to pull the entire paper tray 10 out of the printer body.

FIGS. 8 to 11 show a second embodiment of the present invention in which the paper receiving means 116 is of a smaller length than the paper receiving means 16 of the first embodiment. This is possible because the paper receiving means 116 is gently curved in cross-section and thus causes paper received thereon to be curved likewise and as the paper is curved it has greater strength and need not be supported for its entire length. The paper receiving means 116 can therefore be shorter and therefore need not be made foldable in the manner of the paper receiving means 16 of the first embodiment. Instead the paper receiving means slides out of a slot formed in the paper tray. When the paper tray is inserted in the printer, the paper receiving means 116 is movable between a position (FIG. 10) in which it lies flush with the front wall of the printer, and an extended position (FIG. 11) in which the paper receiving means 116 is ready to receive paper thereon. A handle 117 is provided to pull out the paper receiving means 116 from the position of FIG. 10 to that of FIG. 11. After use the paper receiving means 116 can be pushed back in. It will also be seen that in the embodiment of FIGS. 8 to 11 the printer is provided with a removable cover 118 to allow access to the print head(s).

Figure 12:
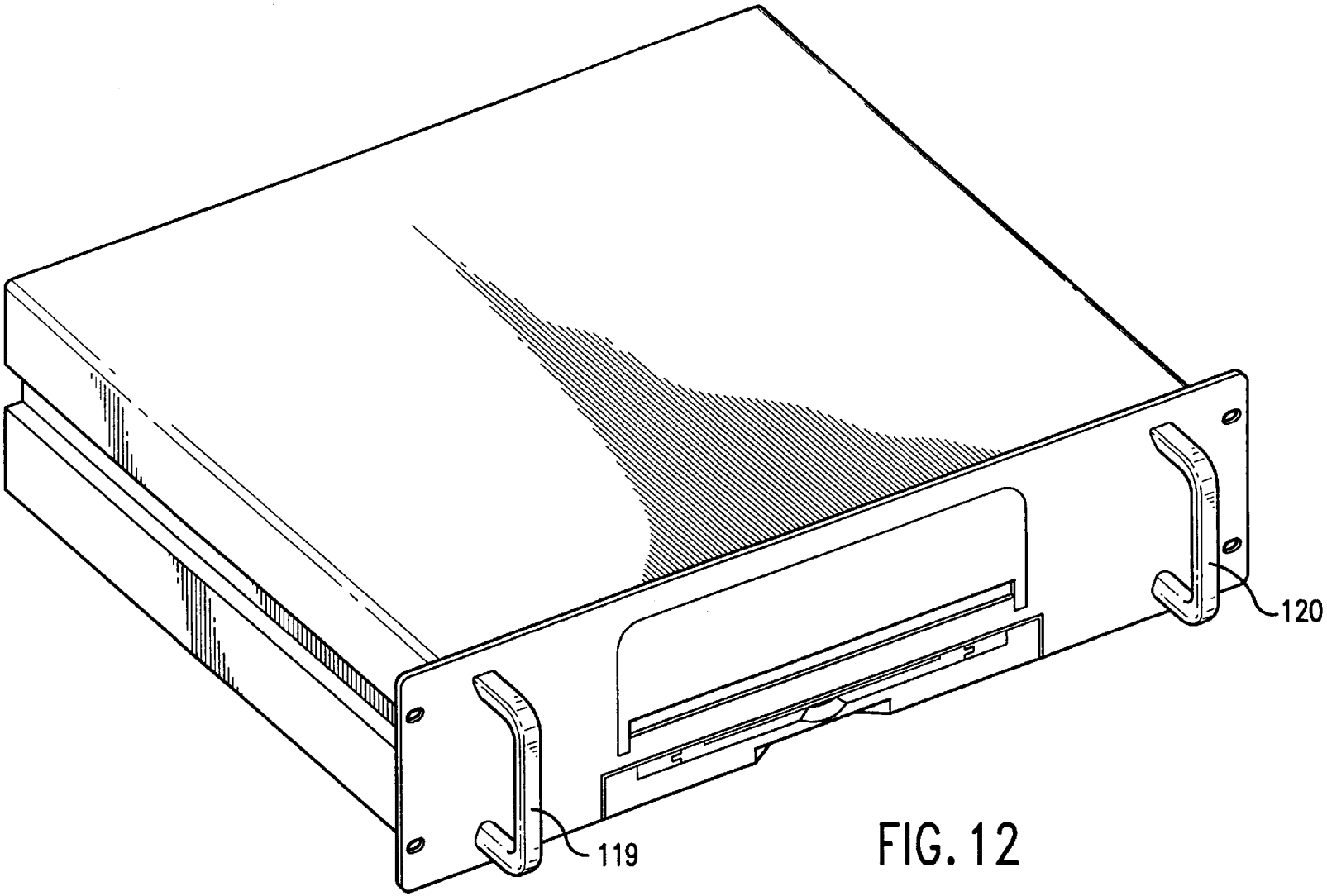
FIG. 12 is a perspective view of a third embodiment.
Figure 15:
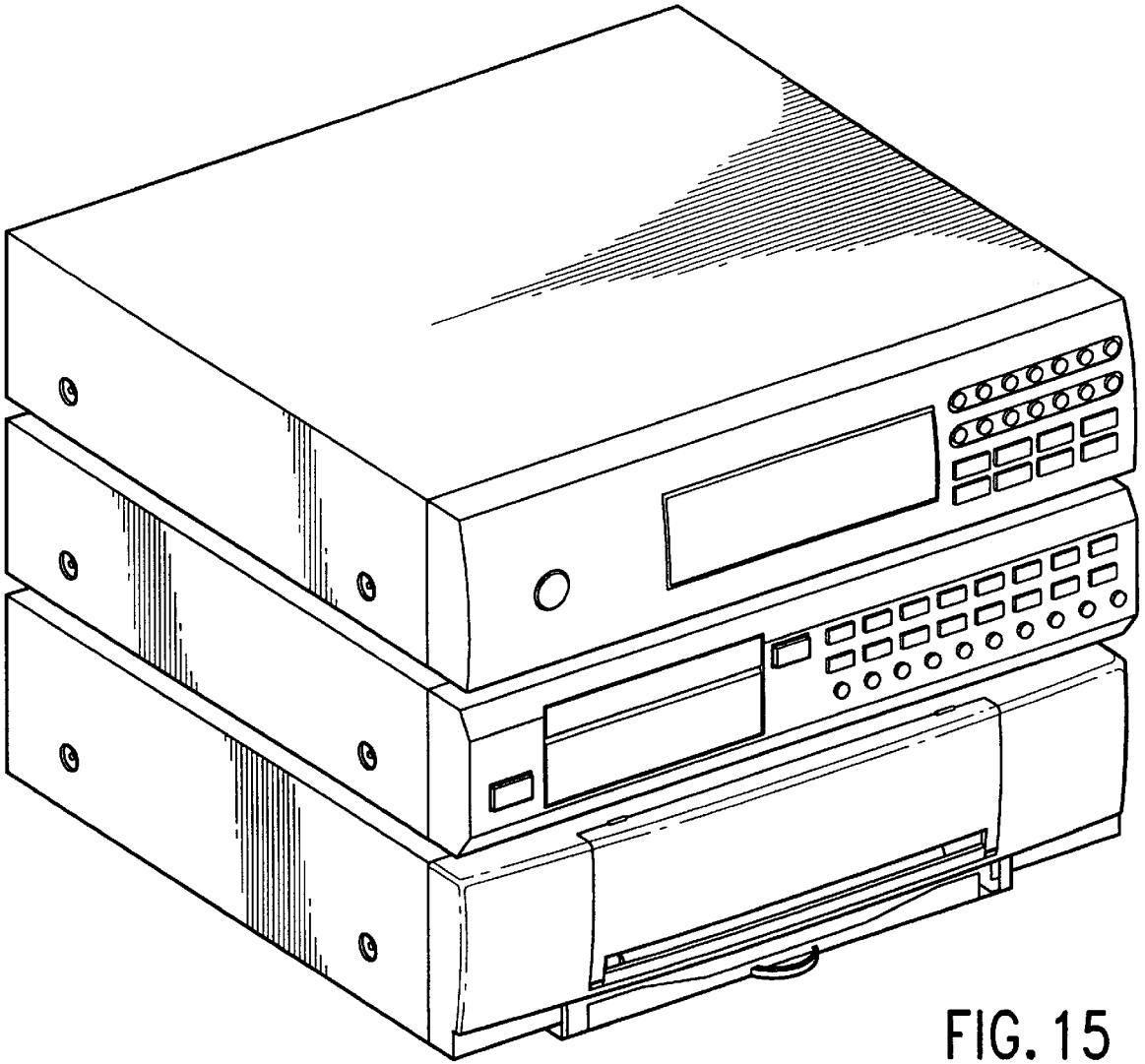
FIG. 15 is a perspective view showing a printer according to an embodiment of the invention received in a stack or devices.

The embodiments of FIGS. 1 to 11 are primarily designed for domestic or office use. As is shown in FIG. 15, such a printer can easily be included in a stack of other electrical and electronic components since in normal use only the front side needs to be accessed. In FIG. 12 is shown an embodiment for a more technical use where the printer is to be installed in a rack of equipment, for example in a laboratory, and in which the front wall of the printer body is formed with handles 119,120 to allow the printer to be slid into and out of an equipment rack.

It will be seen that the paper tray of the present invention is able to both supply paper to the printing means within the printer, and is able to receive paper exiting from the printer after printing is completed. This means that only the side of the printer that receives the paper tray need by exposed for easy access and thus the printer can be received within a stack of similar devices. Furthermore because the paper receiving means is telescopically extendible, the overall size of the paper tray is not significantly larger than a simple paper feeding tray.

Figure 13:
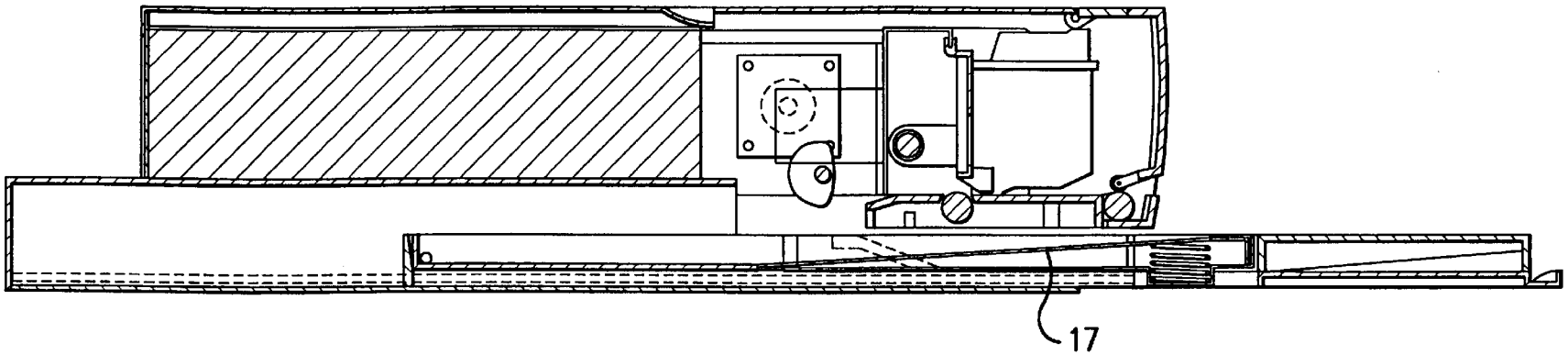
FIGS. 13 and 14 are sectional views through a printer with a paper tray received therein and showing the paper path.
Figure 14:
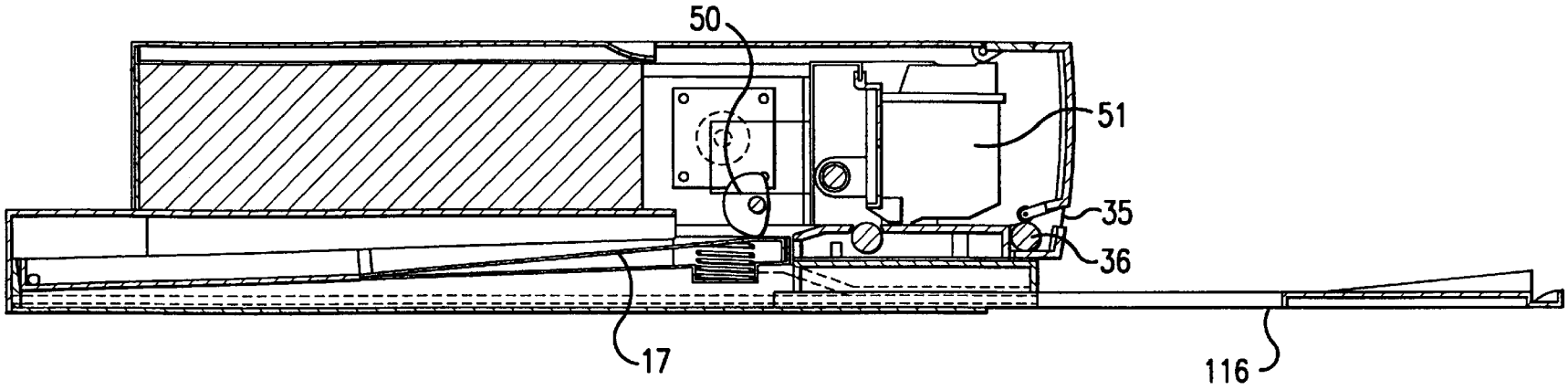

FIG. 13 is a sectional view through a printer showing the paper tray of the embodiment of FIGS. 8 to 11 being inserted into the printer body. FIG. 14 shows the paper tray fully inserted. The base plate 17 of the paper cassette 15 has been moved upwardly such that the top sheet of paper in a stack in the paper cassette 15 is engaged by a pick-up roller 50. Pick-up roller 50 rotates anti-clockwise (as viewed in the figures) so as to draw the top sheet of paper from the stack in a direction from left to right (as viewed in the figures) past printing head 51 and on to discharge slot 35 and discharge roller 36 before being received on paper receiving means 116.

It will be understood that within the printer once a sheet of paper has been taken from a stack held in the paper cassette 15 by a pick-up roller, it is fed to a printing device which may be any form of printing device, eg an ink-jet printing means, bubble-jet printing means or the like, and is returned after printing to an exit slot 35 located slightly above the paper tray insertion slot at which is located a discharge roller 36 that feeds an exiting sheet of paper to the paper receiving means 16. It will also be understood that while reference is made in this specification to a "printer", the invention is applicable to any like piece of apparatus that requires paper to be held in a paper tray, drawn into a machine for printing or a like operation, and then discharged from the machine. In particular the invention would be equally applicable to a fax machine, photocopier or the like, or to a machine that combined any of these functions.

What is claimed is:

1. A paper tray for use in an imaging device, said paper tray being generally rectangular and formed with side and end walls, and having a paper cassette received within said paper tray for holding paper prior to printing thereon, said paper cassette being generally rectangular and formed with side and end walls, and being closely received within at least the side walls and one end wall of the paper tray, wherein the side walls of the paper cassette are formed with cam pins that extend through corresponding vertical slots formed in the side walls of the paper tray, and said paper cassette is moved upon insertion into an imaging device from a lower position in which the paper cassette is completely received within the paper tray such that the walls of the paper tray and the walls of the paper cassette are generally at the same height, to a raised position in which the walls of the paper cassette are raised above the walls of the paper tray, and means for receiving paper exiting the imaging device after printing thereon, wherein said paper receiving means is movable between a first inoperative position and a second operative position in which said paper receiving means is extended to receive paper thereon.

2. A paper tray as claimed in claim 1 wherein when said paper receiving means is in said first position, said paper receiving means is received substantially within the maximum dimensions of the paper tray, whereby, when said tray is inserted in a printer and said paper receiving means is in said first position, substantially all of said tray is received within said printer.

3. A paper tray as claimed in claim 1 wherein said paper receiving means includes at least one paper supporting member that extends telescopically from the paper tray.

4. A paper tray as claimed in claim 3 wherein said tray comprises a first paper supporting member that telescopes with respect to the paper tray, and a second paper supporting member that telescopes with respect to the first member.

5. A paper tray as claimed in claim 3 wherein said tray comprises a paper supporting flap that folds out from an inoperative position to an operative position.

6. A printer including a paper tray that is inserted in a side of the printer, said paper tray being generally rectangular and formed with side and end walls, and having a paper cassette received within said paper tray for holding paper prior to printing thereon, said paper cassette being generally rectangular and formed with side and end walls, and being closely received within at least the side walls and one end wall of the paper tray, wherein the side walls of the paper cassette are formed with cam pins that extend through corresponding vertical slots formed in the side walls of the paper tray and engage cam surfaces formed inside said printer, and said paper cassette is moved upon insertion into the printer from a lower position in which the paper cassette is completely received within the paper tray such that the walls of the paper tray and the walls of the paper cassette are generally at the same height, to a raised position in which the walls of the paper cassette are raised above the walls of the paper tray, and means for receiving paper exiting the printer after printing thereon, wherein said paper receiving means is movable between a first inoperative position and a second operative position in which said paper receiving means is extended to receive paper thereon.

7. A printer as claimed in claim 6 wherein, when said paper receiving means is in said second position, said paper receiving means is received substantially within the maximum dimensions of the paper tray, whereby, when said tray is inserted in a printer and said paper receiving means is in said first position, substantially all of said tray is received within said printer.

8. A printer as claimed in claim 6 wherein said paper receiving means includes at least one paper supporting member that extends telescopically from the paper tray.

9. A printer as claimed in claim 8 wherein said tray comprises a first paper supporting member that telescopes with respect to the paper tray, and a second paper supporting member that telescopes with respect to the first member.

10. A printer as claimed in claim 8 wherein said tray comprises a paper supporting flap that folds out from an inoperative position to an operative position.

11. A printer as claimed in claim 6 wherein said raised position of said paper cassette is a position in which a sheet of paper at the top of a stack of paper held by said paper cassette is urged towards a paper pick-up roller in said printer.

12. A printer as claimed in claim 6 wherein said printer is provided with an insertion slot for receiving said paper tray, and wherein a paper discharge slot is provided immediately above said paper insertion slot.

* * * * *